US008851406B2

(12) United States Patent
Sonwane et al.

(10) Patent No.: US 8,851,406 B2
(45) Date of Patent: Oct. 7, 2014

(54) PUMP APPARATUS INCLUDING DECONSOLIDATOR

(75) Inventors: Chandrashekhar Sonwane, Canoga Park, CA (US); Timothy Saunders, Canoga Park, CA (US); Mark Andrew Fitzsimmons, Canoga Park, CA (US)

(73) Assignee: Aerojet Rocketdyne of DE, Inc., Canoga Park, CA (US)

( * ) Notice: Subject to any disclaimer, the term of this patent is extended or adjusted under 35 U.S.C. 154(b) by 52 days.

(21) Appl. No.: 13/563,401

(22) Filed: Jul. 31, 2012

(65) Prior Publication Data

US 2012/0321444 A1 Dec. 20, 2012

Related U.S. Application Data

(63) Continuation-in-part of application No. 12/758,846, filed on Apr. 13, 2010.

(51) Int. Cl.

| | |
|---|---|
| ***B02C 13/286*** | (2006.01) |
| ***F04B 19/20*** | (2006.01) |
| ***F23G 5/44*** | (2006.01) |
| ***C10J 3/50*** | (2006.01) |

(52) U.S. Cl.

CPC ..... *F23G 5/444* (2013.01); *F04B 19/20* (2013.01); *C10J 2300/0943* (2013.01); *C10J 2200/15* (2013.01); *C10J 3/506* (2013.01); *C10J 2300/093* (2013.01)

USPC ..... 241/101.4; 241/185.6

(58) Field of Classification Search

USPC ..... 110/101 R, 106, 232; 241/3, 101.4, 241/185.6; 415/121.1; 198/523

See application file for complete search history.

(56) References Cited

U.S. PATENT DOCUMENTS

| | | | |
|---|---|---|---|
| 1,011,589 | A | 12/1911 | Curtis |
| 3,245,517 | A | 4/1966 | Ward |
| 3,844,398 | A | 10/1974 | Pinat |
| 3,856,658 | A | 12/1974 | Wolk et al. |
| 3,950,147 | A | 4/1976 | Funk et al. |
| 4,069,911 | A | 1/1978 | Ray |
| 4,191,500 | A | 3/1980 | Oberg et al. |
| 4,197,092 | A | 4/1980 | Bretz |
| 4,206,610 | A | 6/1980 | Santhanam |
| 4,206,713 | A | 6/1980 | Ryason |
| 4,218,222 | A | 8/1980 | Nolan, Jr. et al. |
| 4,356,078 | A | 10/1982 | Heavin et al. |
| 4,377,356 | A | 3/1983 | Santhanam |

(Continued)

FOREIGN PATENT DOCUMENTS

| | | |
|---|---|---|
| EP | 1900941 | 3/2008 |
| GB | 2002025 | 2/1979 |

(Continued)

OTHER PUBLICATIONS

European Search Report dated Aug. 9, 2011. EP App. No./Patent No. 11250450.1215.

(Continued)

*Primary Examiner* — Mark Rosenbaum
(74) *Attorney, Agent, or Firm* — Joel G Landau

(57) ABSTRACT

A pump apparatus includes a particulate pump that defines a passage that extends from an inlet to an outlet. A duct is in flow communication with the outlet. The duct includes a deconsolidator configured to fragment particle agglomerates received from the passage.

14 Claims, 11 Drawing Sheets

(56) References Cited

U.S. PATENT DOCUMENTS

| | | | |
|---|---|---|---|
| 4,391,561 | A | 7/1983 | Smith et al. |
| 4,433,947 | A | 2/1984 | Kratzer et al. |
| 4,488,838 | A | 12/1984 | Herud |
| 4,516,674 | A | 5/1985 | Firth |
| 4,605,352 | A | 8/1986 | Scott et al. |
| 4,611,646 | A | 9/1986 | Wassmer et al. |
| 4,721,420 | A | 1/1988 | Santhanam et al. |
| 4,765,781 | A | 8/1988 | Wilks et al. |
| 4,963,065 | A | 10/1990 | Scott et al. |
| 4,988,239 | A | 1/1991 | Firth |
| 5,051,041 | A | 9/1991 | Firth |
| 5,094,340 | A | 3/1992 | Avakov |
| 5,186,111 | A | 2/1993 | Baria |
| 5,273,556 | A | 12/1993 | McMahon et al. |
| 5,325,603 | A | 7/1994 | Eastham et al. |
| 5,402,876 | A | 4/1995 | Hay |
| 5,435,433 | A | 7/1995 | Jordan et al. |
| 5,485,909 | A | 1/1996 | Hay |
| 5,492,216 | A | 2/1996 | McCoy et al. |
| 5,497,873 | A | 3/1996 | Hay |
| 5,533,650 | A | 7/1996 | Conrad et al. |
| 5,551,553 | A | 9/1996 | Hay |
| 5,558,473 | A | 9/1996 | Lindahl |
| 6,152,668 | A | 11/2000 | Knoch |
| 6,213,289 | B1 | 4/2001 | Hay et al. |
| 6,220,790 | B1 | 4/2001 | Schenk et al. |
| 6,257,567 | B1 | 7/2001 | Hansmann et al. |
| 6,296,110 | B1 | 10/2001 | van Zijderveld et al. |
| 6,533,104 | B1 | 3/2003 | Starlinger-Huemer et al. |
| 6,749,816 | B1 | 6/2004 | Hasegawa et al. |
| 6,875,697 | B2 | 4/2005 | Trivedi |
| 7,303,597 | B2 | 12/2007 | Sprouse et al. |
| 7,360,639 | B2 | 4/2008 | Sprouse et al. |
| 7,387,197 | B2 | 6/2008 | Sprouse et al. |
| 7,402,188 | B2 | 7/2008 | Sprouse |
| 7,615,198 | B2 | 11/2009 | Sprouse et al. |
| 7,717,046 | B2 * | 5/2010 | Sprouse et al. ..... 110/101 R |
| 8,006,827 | B2 | 8/2011 | Aldred et al. |
| 8,011,861 | B2 | 9/2011 | Sprouse et al. |
| RE42,844 | E | 10/2011 | Sprouse et al. |
| 8,308,829 | B1 | 11/2012 | Sprouse et al. |
| 2006/0242907 | A1 | 11/2006 | Sprouse et al. |
| 2006/0243583 | A1 | 11/2006 | Sprouse et al. |
| 2011/0247916 | A1 | 10/2011 | Fitzsimmons |

FOREIGN PATENT DOCUMENTS

| | | |
|---|---|---|
| JP | 3195811 | 8/1991 |
| JP | 6287567 | 10/1994 |
| WO | 2012030682 | 3/2012 |

OTHER PUBLICATIONS

International Search Report and Written Opinion for International Application No. PCT/US2013/045077 completed on Sep. 24, 2013.

* cited by examiner

PUMP APPARATUS INCLUDING DECONSOLIDATOR

RELATED APPLICATION

This application is a continuation-in-part of U.S. application Ser. No. 12/758,846, filed on Apr. 13, 2010.

STATEMENT REGARDING FEDERALLY SPONSORED RESEARCH OR DEVELOPMENT

This invention was made with government support under contract number DE FC26-04NT42237 awarded by United States Department of Energy. The government has certain rights in the invention.

BACKGROUND

Coal gasification involves the conversion of coal or other carbon-containing solids into synthesis gas. While both dry coal and water slurry are used in the gasification process, dry coal pumping may be more thermally efficient than water slurry technology.

In order to streamline the process and increase the mechanical efficiency of dry coal gasification, a particulate material extrusion pump is utilized to pump pulverized carbon-based fuel such as dry coal. The pulverized carbon-based fuel downstream of the particulate material extrusion pump requires breaker mills, ball end mills or other pulverization machines to deconsolidate the dry coal.

SUMMARY

A pump apparatus according to one non-limiting embodiment of the present disclosure includes a particulate pump defining a passage extending from an inlet to an outlet and a duct in flow communication with the outlet. The duct includes a deconsolidator configured to fragment particle agglomerates received from the passage.

In a further non-limiting embodiment of any of the examples herein, the deconsolidator is selected from the group consisting of a grinder, a vibrator, a mesh, a divider and combinations thereof.

In a further non-limiting embodiment of any of the examples herein, the duct is connected at the outlet of the passage.

In a further non-limiting embodiment of any of the examples herein, the duct includes a duct outlet and a movable door having open and closed positions with respect to the duct outlet.

In a further non-limiting embodiment of any of the examples herein, the deconsolidator is a divider splitting the duct into multiple passages.

In a further non-limiting embodiment of any of the examples herein, the multiple passages turn laterally with respect to the passage of the particulate pump.

In a further non-limiting embodiment of any of the examples herein, the multiple passages are laterally offset from each other.

In a further non-limiting embodiment of any of the examples herein, the deconsolidator includes a grinder.

In a further non-limiting embodiment of any of the examples herein, the deconsolidator includes a vibrator.

In a further non-limiting embodiment of any of the examples herein, the deconsolidator includes a mesh.

In a further non-limiting embodiment of any of the examples herein, the duct includes a hard-face coating.

A pump apparatus according to a non-limiting embodiment of the present disclosure includes a particulate pump defining a passage extending from an inlet and an outlet and a duct in flow communication with the outlet. The duct includes a duct outlet and a moveable door having open and closed positions with respect to the duct outlet.

In a further non-limiting embodiment of any of the examples herein, the movable door is biased toward the closed position.

In a further non-limiting embodiment of any of the examples herein, the movable door is movable in response to a pressure in the duct exceeding a threshold.

In a further non-limiting embodiment of any of the examples herein, the movable door is moveable by non-electronic actuation.

In a further non-limiting embodiment of any of the examples herein, the movable door seals against the duct outlet in the closed position.

A method of operating a pump apparatus according to a non-limiting embodiment of the present disclosure includes moving a particulate material through a particulate pump that defines a passage that extends from an inlet to an outlet and fragmenting particle agglomerates of the particulate material with a deconsolidator in a duct that is in flow communication with the outlet of the passage.

A further non-limiting embodiment of any of the examples herein includes controlling discharge of the particulate material from the duct by actuating a movable door between open and closed positions with respect to a duct outlet of the duct.

In a further non-limiting embodiment of any of the examples herein, the actuating includes actuating the movable door in response to a pressure in the duct.

A further non-limiting embodiment of any of the examples herein includes maintaining the movable door in the closed position in response to the pressure in the duct being below a threshold, to limit a backflow of pressure into the duct.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
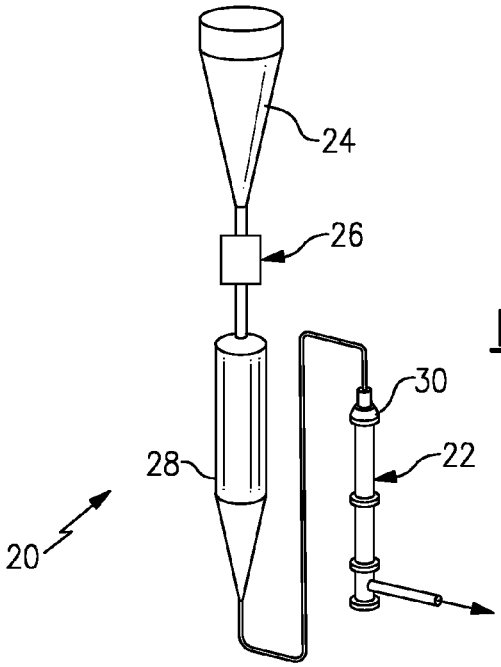
FIG. 1 is an example carbonaceous gasifier system.

FIG. 1 schematically illustrates selected portions of a carbonaceous gasifier system 20 configured for gasification of coal, petcoke or the like to produce synthesis gas (also known as "syngas"). In this example, the gasifier system 20 generally includes an entrained-flow gasifier 22, or reactor vessel. The gasifier 22 is connected with a low pressure hopper 24, a pump apparatus 26 and a high pressure tank 28 for providing carbonaceous particulate material to the gasifier 22.

The gasifier 22 includes an injector 30 to receive and inject the carbonaceous particulate material and an oxidant into the interior volume of the gasifier 22. As an example, the injector 30 is an impingement-style, jet injector. The carbonaceous particulate material combusts within the gasifier 22 to produce the syngas, which may then be provided downstream to one or more filters for further processing, as is known.

Although the pump apparatus 26 is discussed herein with regard to moving carbonaceous particulate material, the pump apparatus 26 may be used in other systems to transport other types of particulate material in various industries, such as petrochemical, electrical power, food and agricultural. That is, the pump apparatus 26 is not limited to use with coal, carbonaceous materials or gasification, and any industry that processes particulate material may benefit from the pump apparatus 26.

Figure 2:
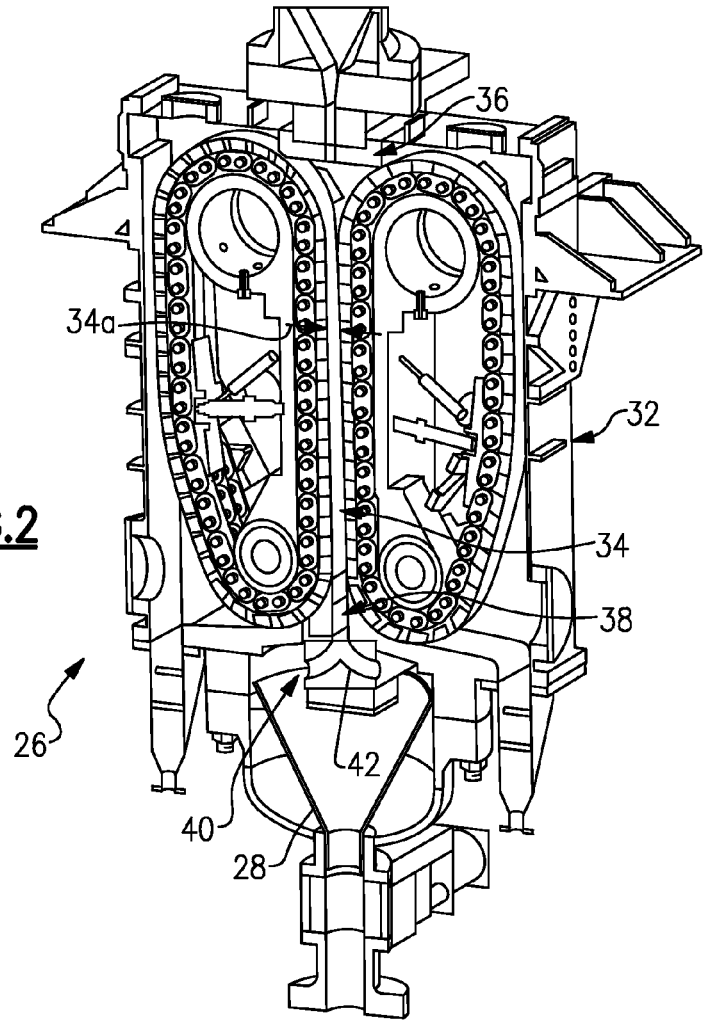
FIG. 2 is an example pump apparatus including a deconsolidator.

FIG. 2 shows an example of the pump apparatus 26. The pump apparatus 26 generally includes a particulate pump 32 (particulate extrusion pump) that defines a passage 34 that extends between an inlet 36 and an outlet 38. A "particulate pump" as used herein refers to a pump that is configured to move particulate material from a low pressure environment, such as the low pressure hopper 24, to a high pressure environment, such as the high pressure tank 28. The particulate pump 32 constricts lateral movement of the particulate material and thereby consolidates the particulate material into a plug of consolidated particulate material. The plug is densely packed to function as a seal that limits backflow of gas, although a limited amount of gas may leak through open interstices between the packed particles. The plug acts as a "dynamic seal" that is in continuous motion as the particulate material compacts and replenishes consolidated particulate material of the plug that is discharged.

In this example, the passage 34 includes a cross-sectional area, as represented by dimension 34*a*, which is substantially constant between the inlet 36 and the outlet 38 of the particulate pump 32. That is, the cross-sectional area does not vary by more than 10% along the length of the passage 34.

It is to be understood that the particulate pump 32 can alternatively be another type of particulate pump. As an example, the particulate pump 32 is a moving-wall pump, a piston pump, a screw pump, a centrifugal pump, a radial pump, an axial pump or other type of mechanical pump configured to move particulate material. One example moving-wall pump is disclosed in U.S. Pat. No. 7,387,197, incorporated herein by reference. Further, in operation, the inlet 36 may be at a first pressure and the outlet 38 may be at a second pressure that is greater than the first fluid pressure such that the particulate pump 32 moves the particulate material from a low pressure area to a higher pressure area.

A duct 40 (shown schematically) is coupled at the outlet 38 of the particulate pump 32. The duct 40 includes deconsolidator 42 configured to fragment particle agglomerates received from the passage 34. The duct 40 and/or deconsolidator 42 may be part of the particulate pump 32 or a separate part from the particulate pump 32. On average, the particulate material discharged from the pump apparatus 26 should have a similar size to the size of the particulate material before entering the pump apparatus 26. However, the particulate material can agglomerate into larger lumps or blocks due to compression at the sidewalls of the passage 34 of the particulate pump 32. The agglomerates can cause blockages further downstream in the gasifier system 20, such as at the injector 30.

The degree of agglomeration can depend upon various coal parameters, such as porosity, Hardgrove Grindability Index (HGI), surface energy, flow rate and discharge pressure. The deconsolidator 42 serves to apply shear forces to the particulate material, which fragments agglomerates that may form. Furthermore, the ability to fragment agglomerates permits the use of different feedstocks such as petcoke, coal from different mine sources, sub-bit coal or the like without the need to replace hardware on the pump apparatus 26 to account for different levels of agglomeration of different feedstocks.

Figure 3A:
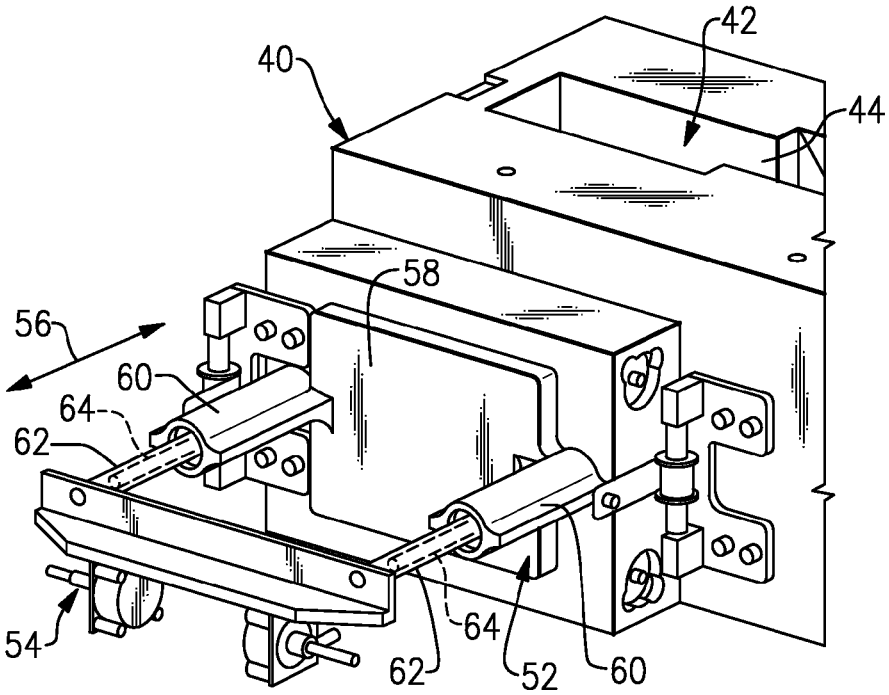
FIG. 3A is a portion of a duct and deconsolidator of a pump apparatus.
Figure 3B:
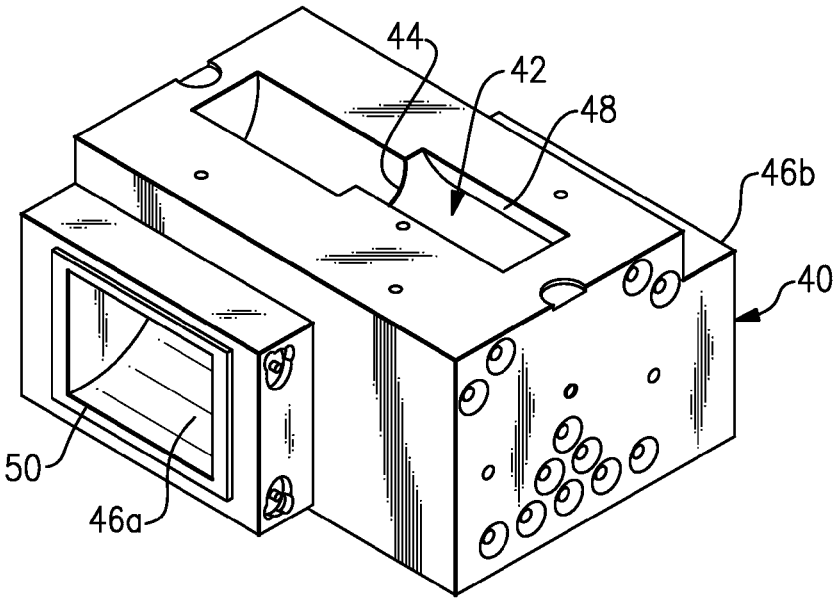
FIG. 3B is a portion of a duct and deconsolidator of FIG. 3A.

FIGS. 3A and 3B show selected portions of the duct 40 and the deconsolidator 42. The deconsolidator 42 can include a divider (i.e., splitter), a grinder, a vibrator, a mesh or combinations thereof to fragment, or breakup, agglomerates. In the illustrated example, the deconsolidator 42 includes a divider 44. The divider 44 splits the duct 40 into multiple passages 46*a*/46*b*, which are laterally offset from each other in this example, to generate a shear force on the flowing particulate matter and thereby fragment agglomerates. Each of the passages 46*a*/46*b* receives particulate material from the passage 34 of the particulate pump 32 through an opening 48 on the top of the duct 40. In this example, each of the passages 46*a*/46*b* turns laterally with respect to the longitudinal length of the passage 34 of the particulate pump 32 and terminates at a duct outlet 50 (one shown). The lateral turning also facilitates the generation of the shear forces.

In this example, the duct 40 also includes a movable door 52 (FIG. 3A) that is movable between open and closed positions with respect to the duct outlet 50. That is, each duct outlet 50 of each corresponding passage 46*a*/46*b* can include a movable door 52.

The movable door 52 is mounted on a door support structure 54 for linear movement, as represented at 56, between open and closed positions. The movable door 52 includes a plate 58 with guide bosses 60 extending therefrom. The guide bosses 60 are slideably supported on respective struts 62 of the support structure 54. The struts 62 house bias members 64 (shown schematically), such as springs, for biasing the movable door 52 toward the closed position shown in FIG. 3A.

Figure 4A:
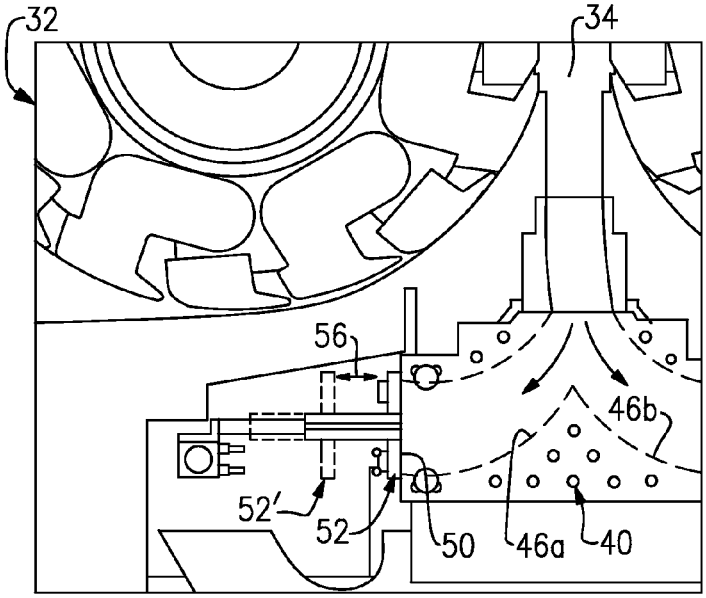
FIG. 4 is a portion of a pump apparatus and deconsolidator in operation.
Figure 4B:
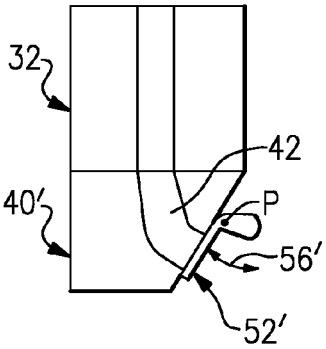

Referring to FIG. 4, the moveable door 52 is movable along linear direction 56 between a closed position in which the movable door 52 seals the duct outlet 50 and an open position, shown in phantom at 52', in which the movable door 52 permits particulate material to discharge through the duct outlet 50.

In this example, the movable door 52 actuates by non-electronic actuation and in response to a pressure in the duct 40 exceeding a threshold. Thus, the moveable door 52 operates passively, without the need for external electronic control signals. For example, in operation of the pump apparatus 26, particulate material moves through the passage 34 and into the duct 40. A build-up of particulate material in the duct 40 causes a pressure increase within the duct 40. Once the pressure exceeds the threshold pressure necessary to overcome the biasing force of the bias member 64, the movable door 52 slides on the struts 62 from the closed position to the open position at 52'.

Once open, the particulate material discharges through the duct outlet 50 and into the high pressure tank 28. Upon release of particulate material into the high pressure tank 28, the pressure within the duct 40 decreases and the bias member 64 moves the movable door 52 back into the closed position, sealing the duct outlet 50. A backflow of pressure can go through a plug of the particulate material that forms in the passage 34 of the particulate pump 32 and discharge as a stream of particulate material from the inlet 36 of the particulate pump 32. However, in the closed, sealed position, the moveable door 52 limits or prevents pressure backflow through the duct 40 and into the particulate pump 32, which facilitates isolation of the low pressure environment at the inlet 36 from the high pressure environment at the outlet 38 and improves operation of the particulate pump 32 by reducing the need to re-pressurize the low pressure environment due to undesired pressure losses.

Figure 5:
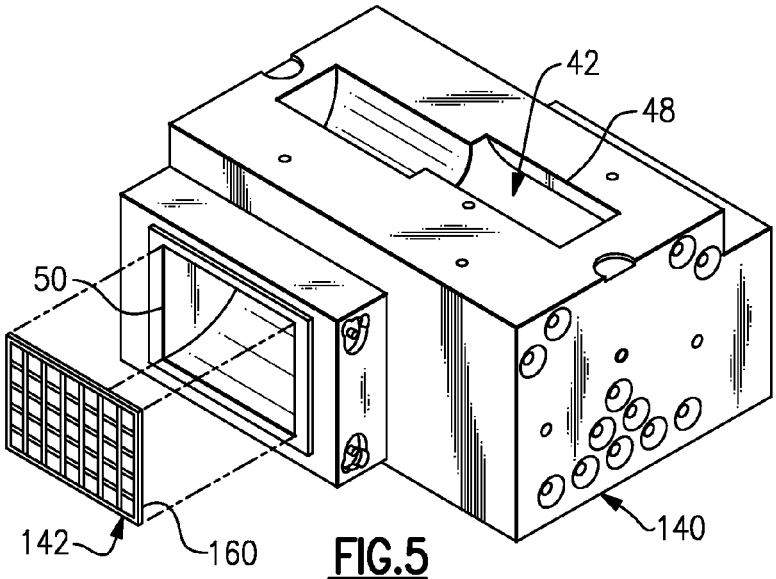
FIG. 5 is another example duct and deconsolidator.

FIG. 5 illustrates selected portions of another example duct 140 that is somewhat similar to the duct 40 described above. In this disclosure, like elements are understood to incorporate the same features and benefits of the corresponding elements. In this example, the duct 140 includes an additional deconsolidator 142 that is a mesh 160 arranged over the duct outlet 50 of the duct 140. For example, the mesh 160 is a wire screen that is mounted over the duct outlet 50 and serves to fragment particle agglomerates that are not already fragmented by the deconsolidator 42. Alternatively, or in addition to the mesh 160, another mesh 160 can be provided over the opening 48.

Figure 6:
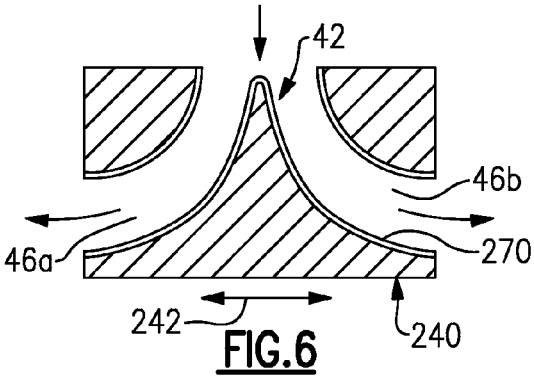
FIG. 6 is another example duct and deconsolidator.

FIG. 6 illustrates another example duct 240 that is somewhat similar in geometry to the duct 40 as described above. That is, the duct 240 includes the deconsolidator 42, or divider, that splits into the passages 46*a*/46*b*. However, in this example, the duct 240 additionally includes a deconsolidator represented at 242. The deconsolidator 242 is a vibrator that moves the duct 240 laterally to further facilitate the fragmentation of particle agglomerates received from the passage 34 of the particulate pump 32. As an example, the deconsolidator 242 includes an actuator to vibrate the duct 240 at a desired frequency to fragment the particle agglomerates. The vibration can be linear or rotatory, for example.

Additionally, in this example, the duct 240 includes a hard-face coating 270 that lines the passages 46*a*/46*b* to protect against erosion, corrosion and the like. In one example, the hard-face coating 270 is an anodized coating on an aluminum substrate that forms the geometry of the duct 240. In other examples, the hard-face coating 270 can have a different composition, but is harder than the underlying substrate on which it is disposed. As can be appreciated, any of the hard-face coating 270 is also applicable to any of the other examples herein.

Figure 7:
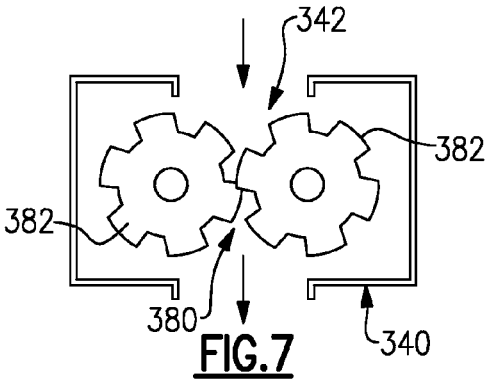
FIG. 7 is another example duct and deconsolidator that includes a grinder.

FIG. 7 illustrates another example duct 340 that includes a deconsolidator 342. In this example, the deconsolidator 342 includes a grinder 380. The grinder 380 in this example includes moving or rotatable pieces 382 that exert shear forces on the particulate material received from the passage 34 of the particulate pump 32 to fragment particle agglomerates.

Moreover, the use of the movable door reduces backflow of high pressure coal or gases in the system, which may otherwise hinder the feed of the coal particulate material or cause shutdown of system. Additionally, the duct and deconsolidators disclosed herein can be retrofit onto an existing particulate pump in response to a change in feedstock, flow rate, etc. In some examples, the duct and deconsolidator requires minimal energy input, which reduce auxiliary loads on the particulate pump.

Figure 8:
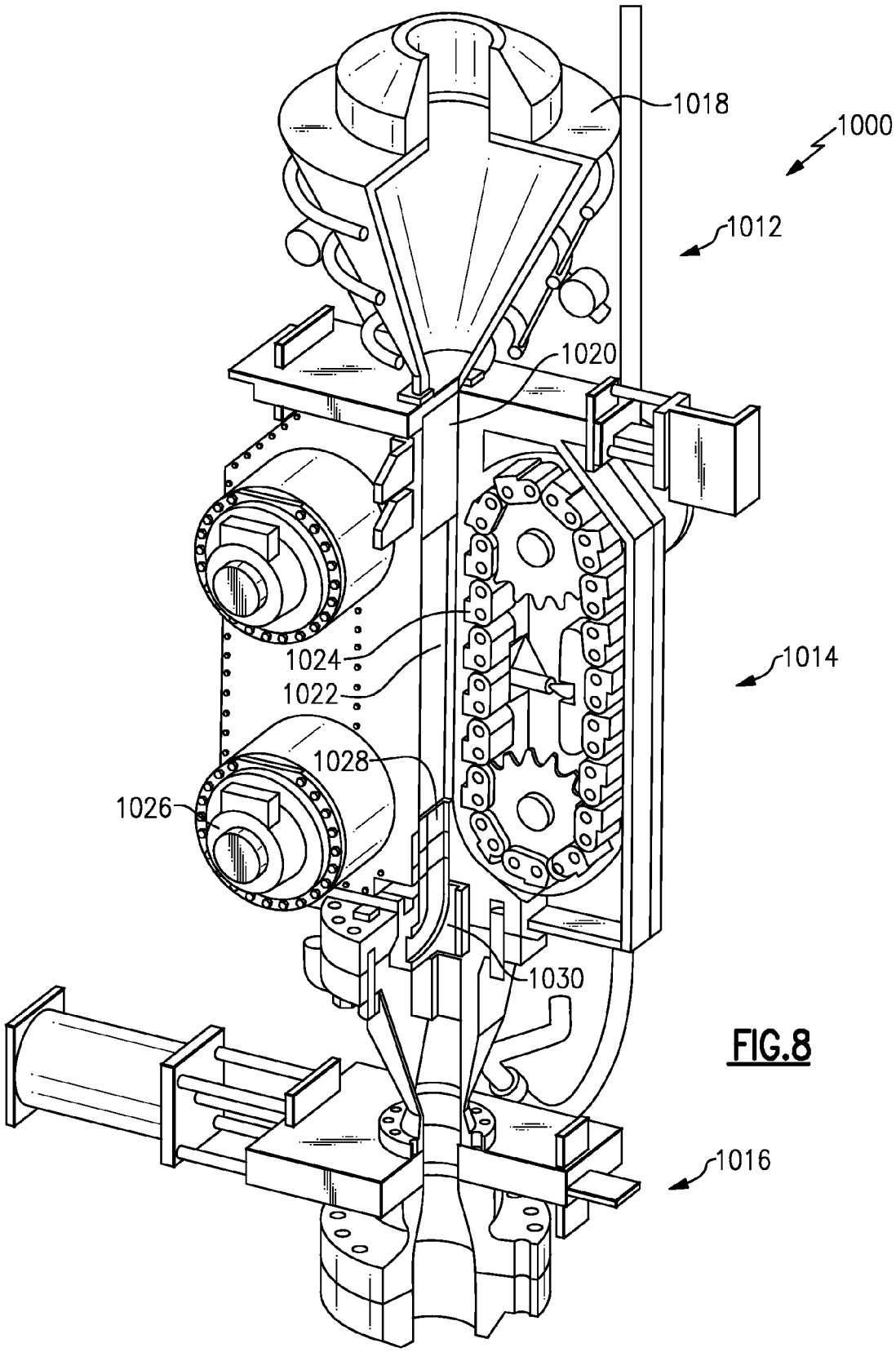
FIG. 8 is a perspective view of a dry coal extrusion pump.

FIG. 8 schematically illustrates a perspective view of a particulate material extrusion pump 1000 for transportation of a dry particulate material. Although particulate pump 1000 is discussed as a transport for pulverized carbon-based fuel such as coal, biomass, petroleum coke, waste or other feedstock, the particulate pump 1000 may alternatively transport any dry particulate material and may be used in various other industries, including, but not limited to: coal gasification, petrochemical, electrical power, food, and agricultural.

The particulate pump 1000 generally includes an inlet zone 1012, a compression work zone 1014 and an outlet zone 1016. The inlet zone 1012 generally includes a hopper 1018 and an inlet 1020. The compression work zone 1014 generally includes a passageway 1022 defined by a moving wall 1024 and drives system 1026 therefor. The outlet zone 1016 generally includes an outlet 1028 and a deconsolidation device 1030.

The deconsolidation device 1030 deconsolidates the coal which may be consolidated within the passageway 1022 by the moving wall 1024. That is, the pulverized carbon-based fuel may be tightly compacted from the passageway 1022. The pulverized carbon-based fuel has a natural angle of repose. That is, a natural angle forms between the horizontal at the top of a pile of unconsolidated material, and the sides. The consolidated pulverized carbon-based fuel has been compressed into a state where the particulate adhere to each other forming a mass which may stand vertically unsupported at angles higher than the natural angle of repose. Partially deconsolidated material may have a natural angle of repose but still consist of a mixture of unconsolidated and consolidated material that may be further reduced by shearing the largest particle masses against each other or the surfaces of a device.

Figure 9:
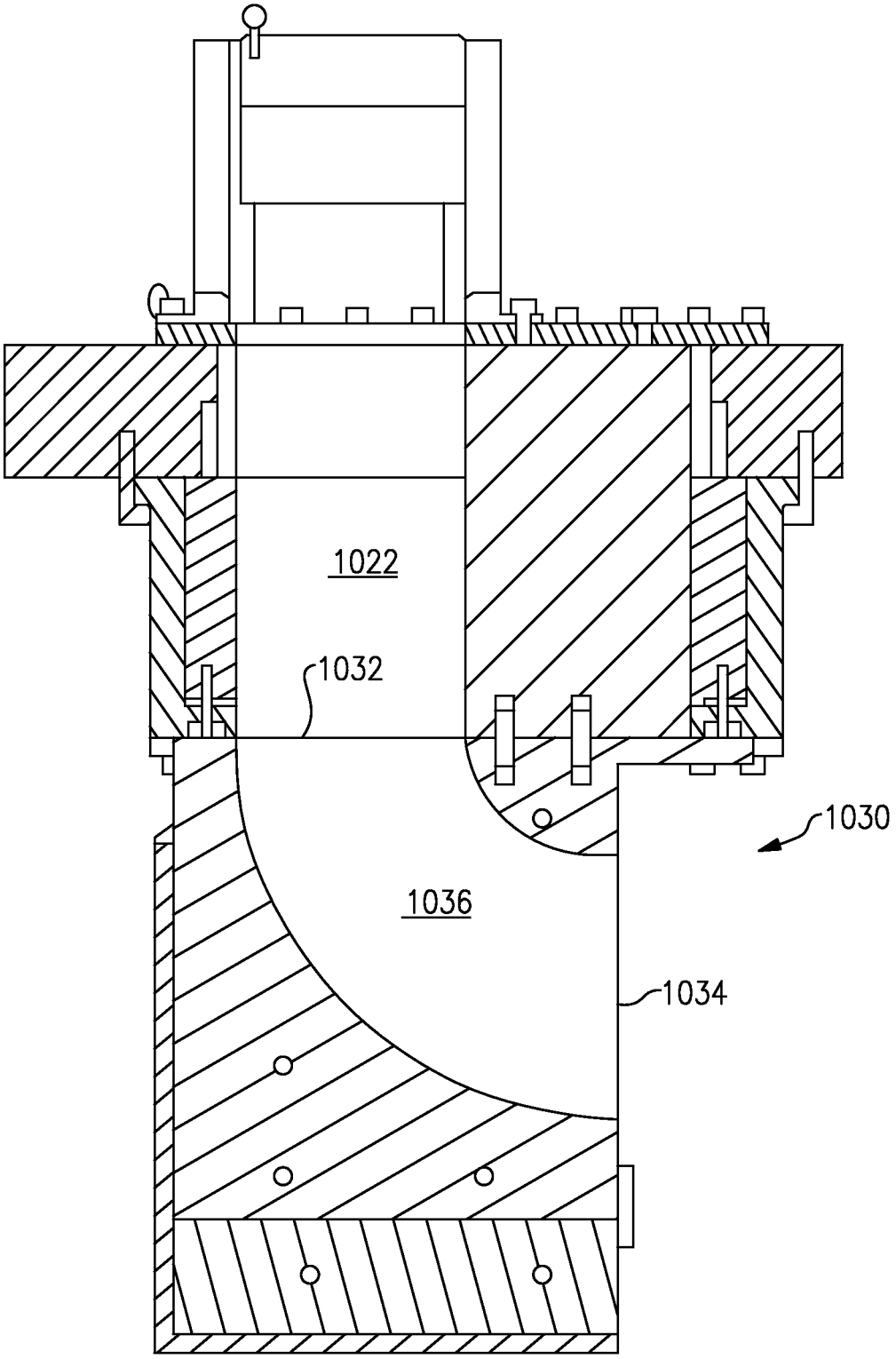
FIG. 9 is a sectional view of a deconsolidation device.

Referring to FIG. 9, the deconsolidation device 1030 includes an inlet 1032 which defines a first cross-section which is generally equivalent to the cross-section formed by the passageway 1022 and an outlet 1034 which defines a second cross-section different than the first cross-section to break the compressed pulverized consolidated particulate into a fine powder consistency. After being passed through the device once, the carbon based material is no longer prevented from lying at a natural angle of repose. The flow path 1036 between the inlet 1032 and the outlet 1034 forces pulverized coal particles to move in relation to each other without recompaction. A three dimensional shape change is provided by a flow path 1036 between the inlet 1032 and the outlet 1034 of the deconsolidation device 1030. The flow path 1036 provides the requisite particle breakage as the pulverized carbon-based fuel is forced to change direction and allowed to expand in volume.

Figure 10:
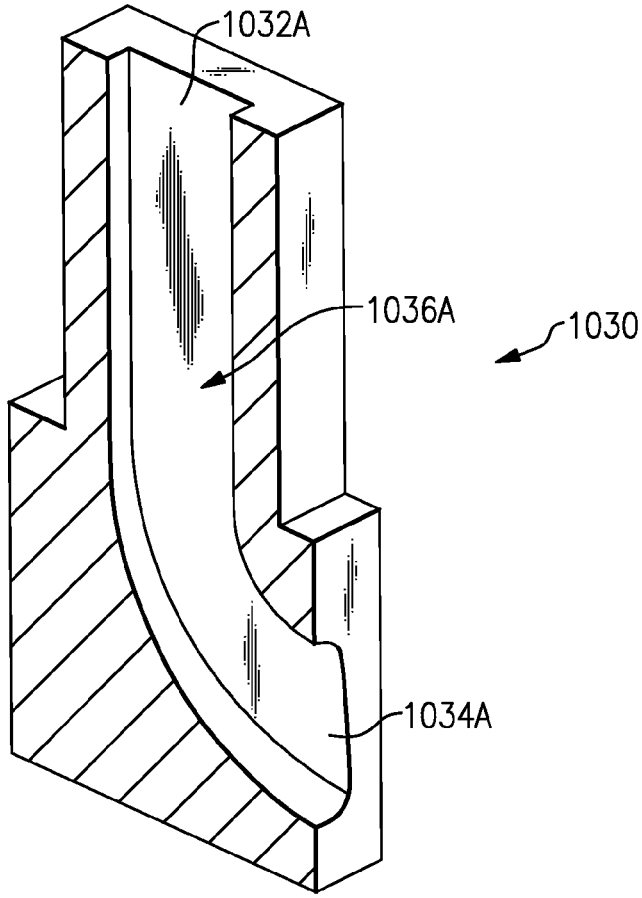
FIG. 10 is a sectional view of a one non-limiting embodiment of a deconsolidation device.

Referring to FIG. 10, one non-limiting embodiment of the flow path 1036A of the deconsolidation device 1030 provides a rectilinear inlet 1032A as the first cross-section which is generally equivalent to the cross-section formed by the passageway 1022, and an outlet 1034A which defines the second cross-section which includes radiused corners. The flow path 1036A also turns through an at least ninety (90) degree turning angle.

Figure 11:
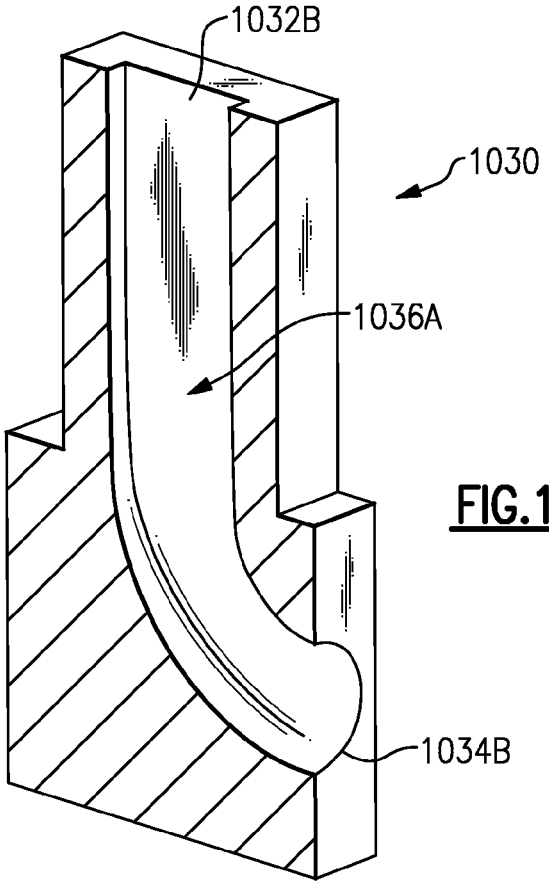
FIG. 11 is a sectional view of a another non-limiting embodiment of a deconsolidation device.

Referring to FIG. 11, another non-limiting embodiment of the flow path 1036B of the coal deconsolidation device 1030 provides a rectilinear inlet 1032B as the first cross-section which is generally equivalent to the cross-section formed by the passageway 1022, and an outlet 1034B which defines the second cross-section which defines a round outlet. The flow path 1036A also turns through an at least ninety (90) degree turning angle.

Figure 12:
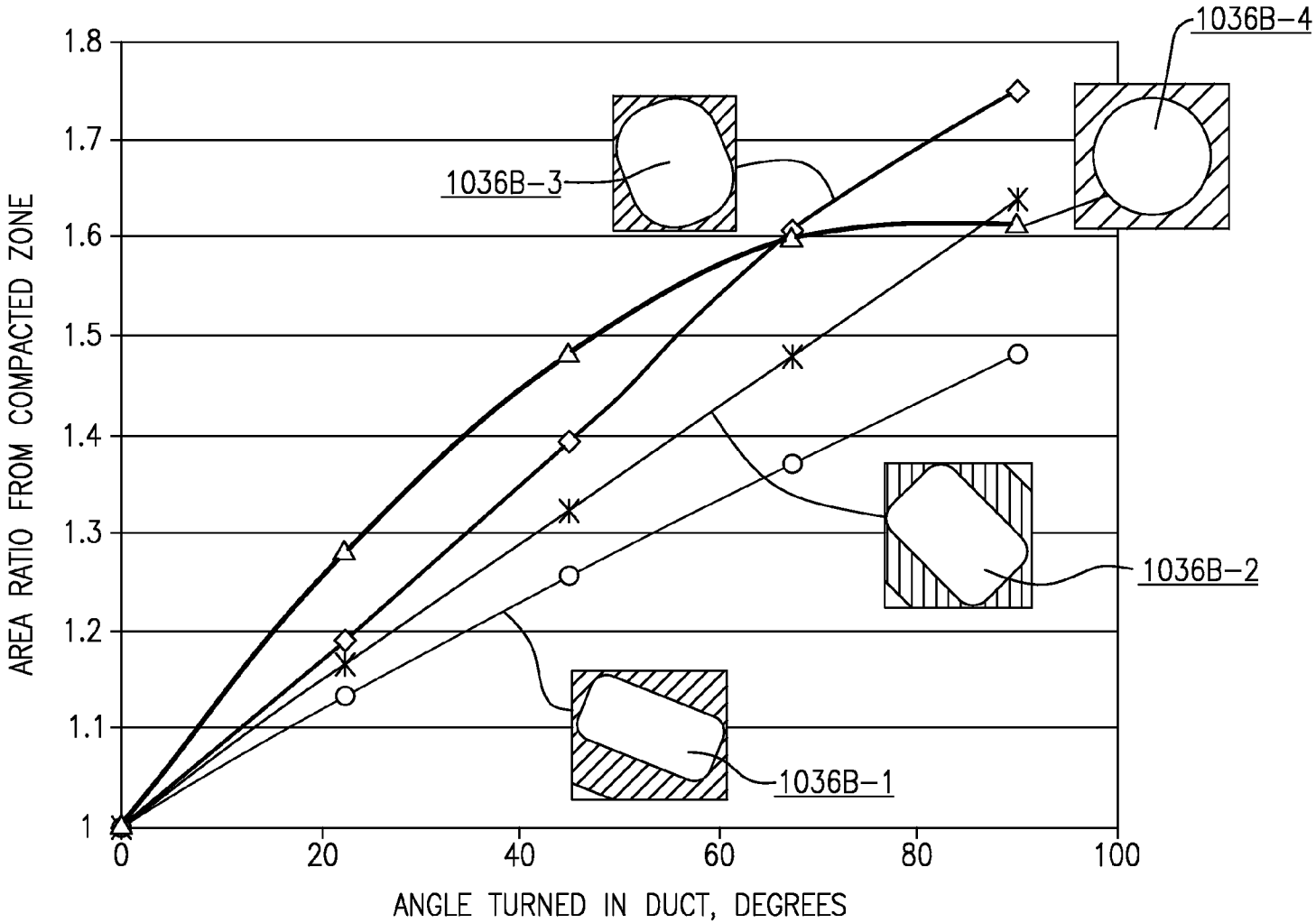
FIG. 12 is a graphical representation of various deconsolidation device flow path area ratio and angle relationship.

Referring to FIG. 12, various tradeoffs result from the relationship along the flow path 1036. It should be understood that various combinations of area ratios along the flow path 1036 may be utilized herewith. The transition from a rectilinear inlet to a round outlet results in an increase in area relatively slowly along the flow path 1036B-1, 1036B-2, 1036B-3, 1036B-4 while changing the shape relatively more quickly. A relatively simple angle is also effective yet total efficiency may be relatively less.

Figure 13:
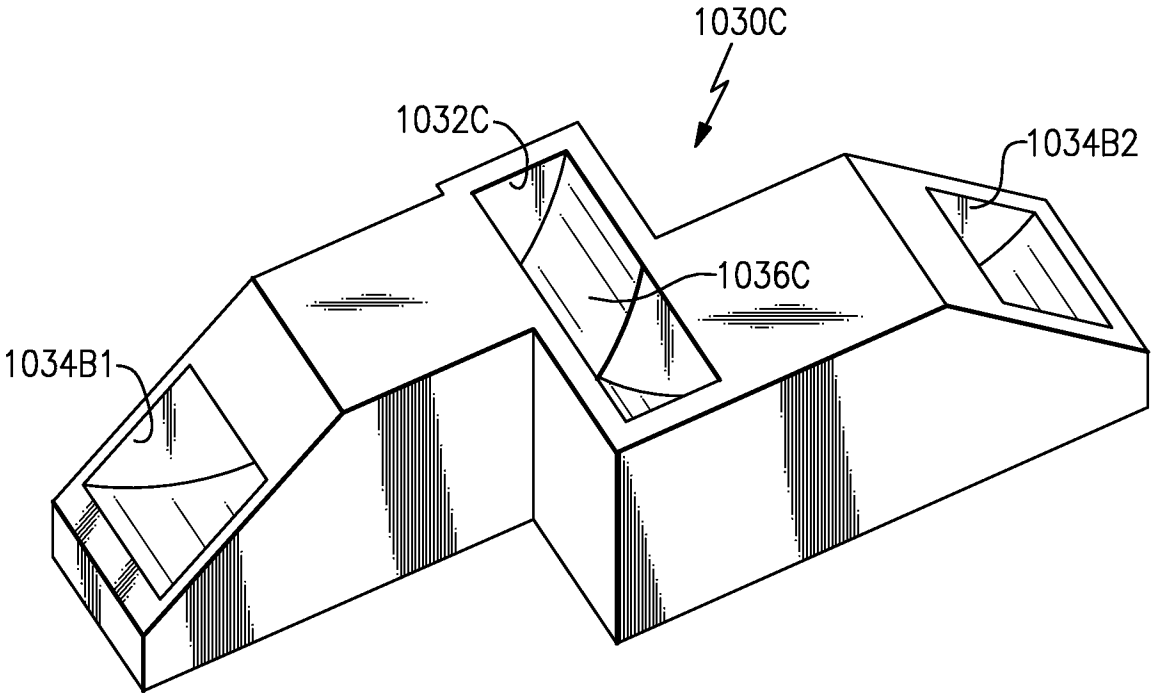
FIG. 13 is a perspective view of a deconsolidation device with one non-limiting embodiment of a flow control arrangement.

Referring to FIG. 13, another non-limiting embodiment of the flow path 1036C of the coal deconsolidation device 1030 provides a rectilinear inlet 1032C as the first cross-section which is generally equivalent to the cross-section formed by the passageway 1022, and a first and second outlet 1034B1, 1034B2 which each define the second cross-section. It should be understood that the first and second outlet 1034B1, 1034B2 may be of various forms such as those discussed above. The flow path 1036C also turns through an at least ninety (90) degree turning angle.

Figure 14:
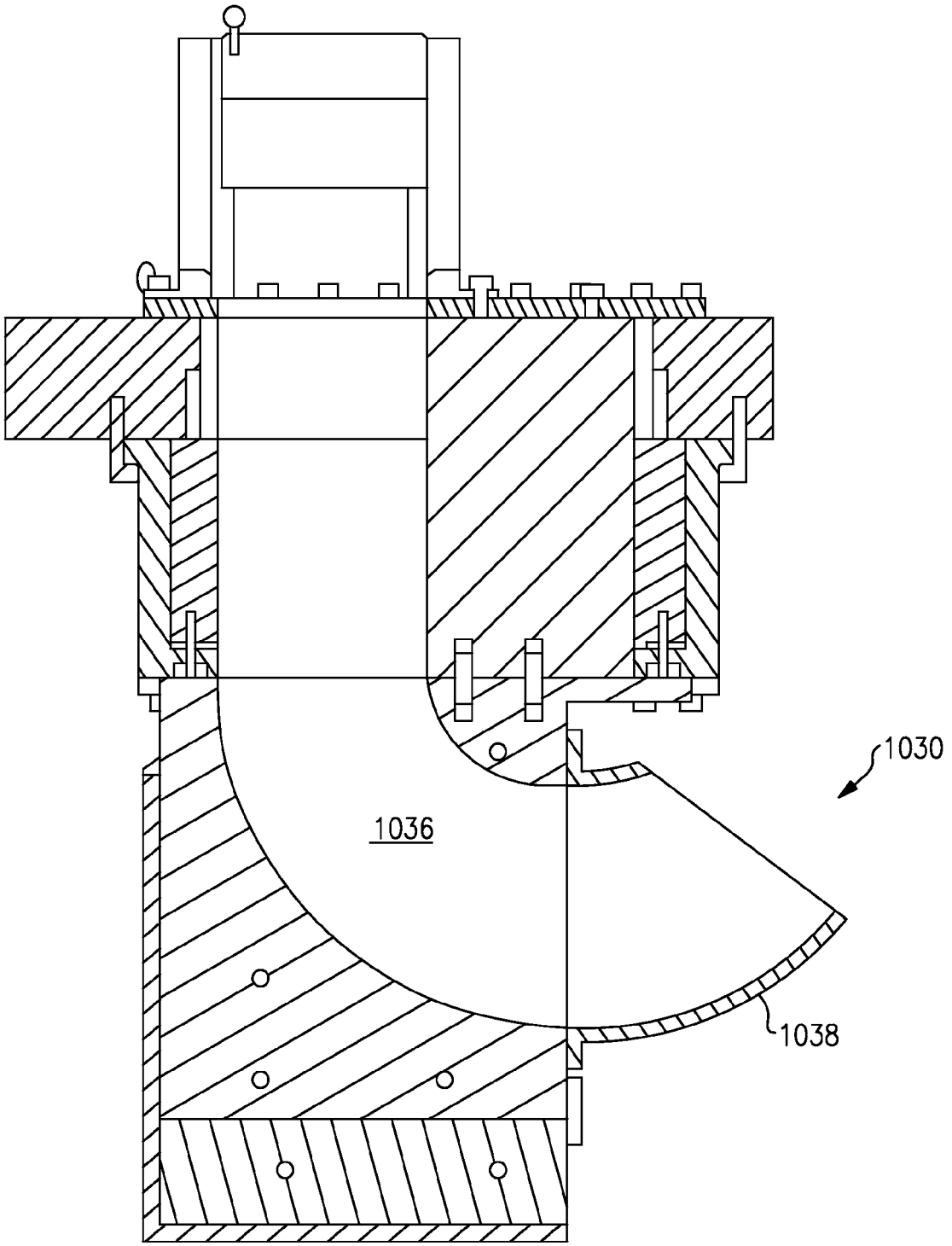
FIG. 14 is a sectional view of a deconsolidation device with one non-limiting embodiment of a flow control arrangement.

Referring to FIG. 14, the flow path 1036 may additionally be arranged to assure the flow path 1036 remains full as the pulverized carbon-based fuel moves through the coal deconsolidation device 1030. In one non-limiting embodiment, the flow path 1036 turns through a turning angle which may be greater than a ninety (90) degree turning angle through an extension 1038. The turning angle may turn through an at least one hundred thirty five (135) degree turning angle which essentially defines a J-shape.

Figure 15:
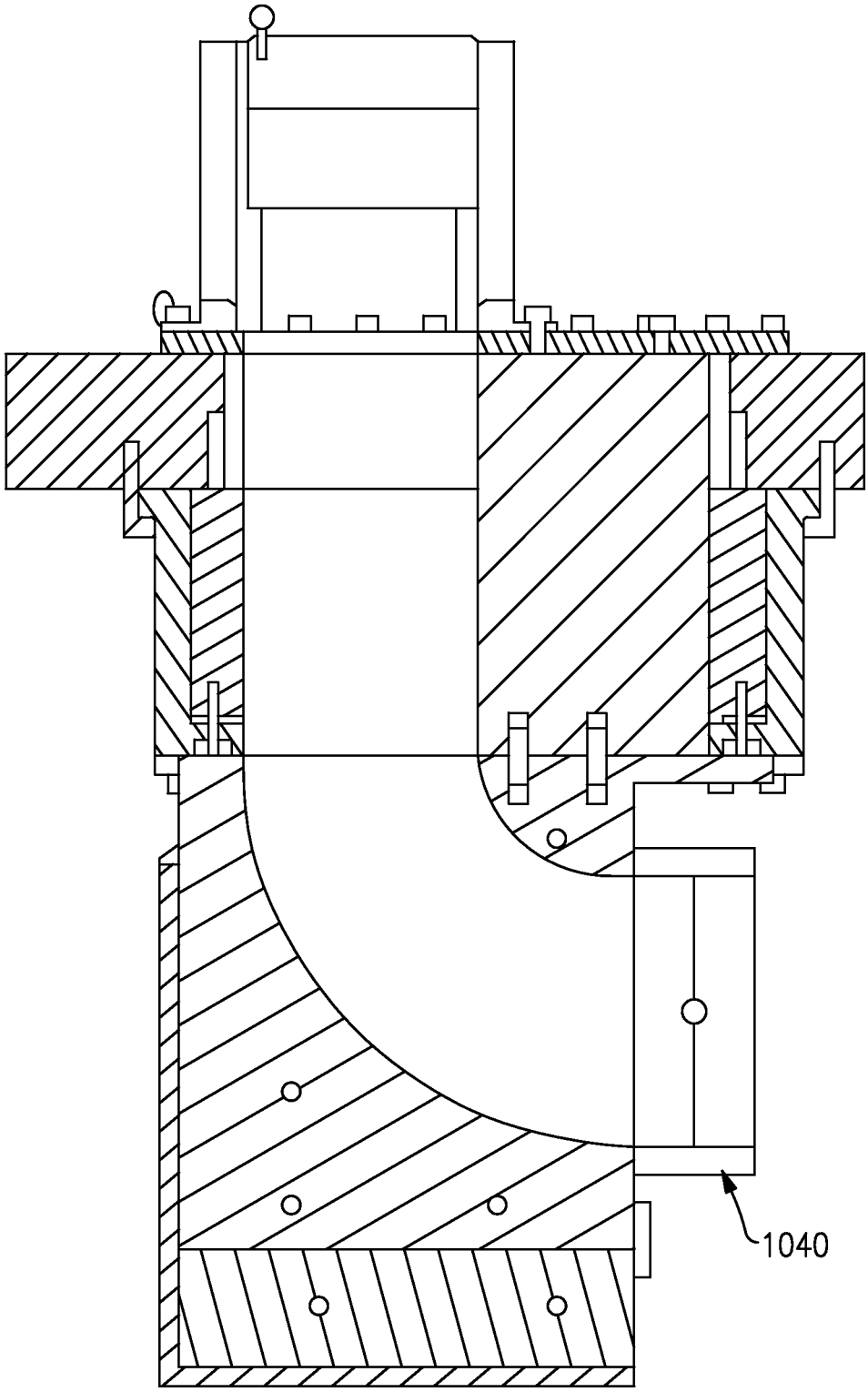
FIG. 15 is a sectional view of a deconsolidation device with another non-limiting embodiment of a flow control arrangement.

Referring to FIG. 15, another non-limiting embodiment includes a valve 1040 (illustrated schematically) to assure the flow path 1036 remains full as the pulverized carbon-based fuel moves through the coal deconsolidation device 1030. The valve 1040 may be a check-valve or other valve arrangement which requires a predetermined pressure for passage of the deconsolidated particulate material.

Figure 16:
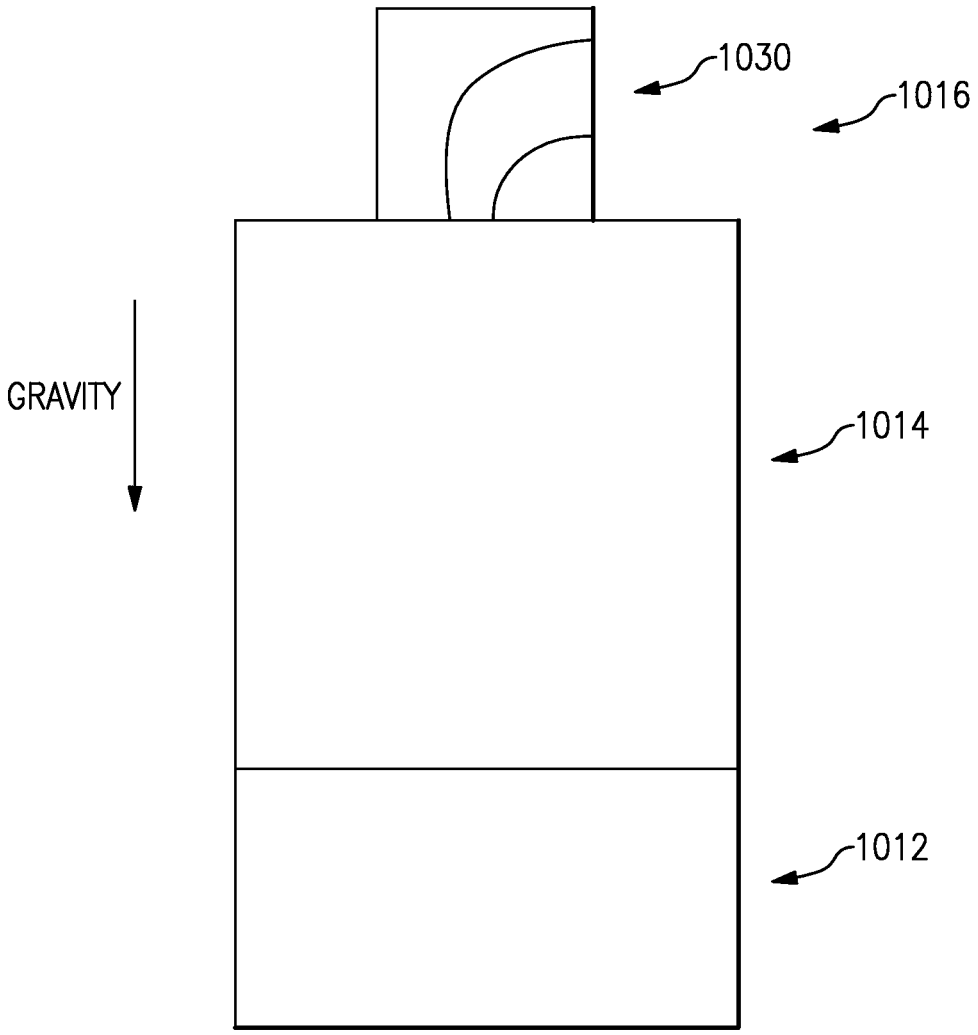
FIG. 16 is a sectional view of a deconsolidation device with another non-limiting embodiment of a flow control arrangement.

Referring to FIG. 16, another non-limiting embodiment arranges the particulate pump 1000 such that the flow path 1036 is arranged in a direction with regard to gravity to assure the flow path 1036 remains full. That is, the coal deconsolidation device 1030 may be located above the particulate pump 1000 with respect to gravity such that the pulverized carbon-based fuel must move in opposition to gravity.

The coal deconsolidation device 1030 allows the particulate pump 1000 to operate without heretofore required breaker mills, ball end mills or other moving pulverization machines.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A pump apparatus comprising:

a particulate pump defining a passage extending from an inlet to an outlet; and a duct in flow communication with the outlet, the duct including a deconsolidator configured to fragment particle agglomerates received from the passage, the deconsolidator including a divider splitting the duct into multiple passages leading to corresponding ones of multiple duct outlets from the deconsolidator.

2. The pump apparatus as recited in claim 1, wherein the duct is connected at the outlet of the passage.

3. The pump apparatus as recited in claim 1, wherein the duct includes multiple moveable doors arranged, respectively, at the multiple duct outlets, the multiple moveable doors having open and closed positions with respect to the multiple duct outlets.

4. The pump apparatus as recited in claim 3, wherein the multiple movable doors are biased toward the closed positions.

5. The pump apparatus as recited in claim 3, wherein the multiple movable doors are movable in response to a pressure in the duct exceeding a threshold.

6. The pump apparatus as recited in claim 3, wherein the multiple movable doors are moveable by non-electronic actuation.

7. The pump apparatus as recited in claim 3, wherein the multiple movable doors seal against the respective multiple duct outlets in the closed positions.

8. The pump apparatus as recited in claim 3, wherein the multiple movable doors are linearly moveable.

9. The pump apparatus as recited in claim 3, wherein the multiple movable doors are passively moveable between the open and closed positions by non-electronic actuation to control discharge from the multiple passages.

10. The pump apparatus as recited in claim 3, wherein each of the multiple moveable doors includes a plate with guide bosses extending therefrom, and the guide bosses are slideably supported on respective struts.

11. The pump apparatus as recited in claim 10, wherein the struts include bias members biasing toward the multiple moveable doors toward the closed positions.

12. The pump apparatus as recited in claim 1, wherein the multiple passages turn laterally with respect to the passage of the particulate pump.

13. The pump apparatus as recited in claim 1, wherein the multiple passages are laterally offset from each other.

14. The pump apparatus as recited in claim 1, wherein the duct includes a hard-face coating.

* * * * *